US007448847B2

(12) United States Patent
Lim

(10) Patent No.: US 7,448,847 B2
(45) Date of Patent: Nov. 11, 2008

(54) TURBINE WITH ADJUSTABLE VANES

(75) Inventor: Chan-sun Lim, Changwon-si (KR)

(73) Assignee: Samsung Techwin Co., Ltd. (KR)

( * ) Notice: Subject to any disclaimer, the term of this patent is extended or adjusted under 35 U.S.C. 154(b) by 682 days.

(21) Appl. No.: 11/174,369

(22) Filed: Jul. 1, 2005

(65) Prior Publication Data

US 2007/0003408 A1 Jan. 4, 2007

(30) Foreign Application Priority Data

Aug. 19, 2004 (KR) ..... 10-2004-0065384

(51) Int. Cl.
*F01D 9/02* (2006.01)

(52) U.S. Cl. ..... 415/147; 415/161; 415/163; 415/164; 415/165

(58) Field of Classification Search ..... 415/161, 415/163, 164, 165, 147; 60/602–604
See application file for complete search history.

(56) References Cited

U.S. PATENT DOCUMENTS 4,378,960 A 4/1983 Lenz ..... 415/115
4,741,666 A * 5/1988 Shimizu et al. ..... 415/158
4,973,223 A 11/1990 Franklin ..... 415/157
5,183,381 A * 2/1993 McKean ..... 415/150
6,652,224 B2 11/2003 Mulloy et al. ..... 415/158
6,672,059 B2 1/2004 Arnold ..... 60/602

* cited by examiner

*Primary Examiner*—Ninh H Nguyen
(74) *Attorney, Agent, or Firm*—Tuchman & Park LLC

(57) ABSTRACT

There is provided an adjustable vane turbine and turbine generator using the same, in which hydrodynamic properties are employed to adjust adjustable vanes automatically in response to flow condition such as the flow rate of the working fluid, thereby simplifying the system using the adjustable vanes and reducing cost. In the adjustable vane turbine, a turbine wheel is installed in a turbine housing and rotatably supported by a shaft, and a plurality of adjustable vanes are movably installed between the turbine housing and the turbine wheel, wherein each of the adjustable vanes includes an adjustable vane member having one end portion rotatably fixed to the turbine housing, a vane control element attached on one side of the adjustable vane member at a set angle, and a guide element attached on the other side of the adjustable vane member, the plurality of adjustable vanes being connected using links between neighboring vanes.

16 Claims, 6 Drawing Sheets

TURBINE WITH ADJUSTABLE VANES

BACKGROUND OF THE INVENTION

This application claims priority of Korean Patent Application No. 10-2004-0065384, filed on Aug. 19, 2004, in the Korean Intellectual Property Office, the disclosure of which is incorporated herein in its entirety by reference.

1. Field of the Invention

The present invention relates to a turbine or a turbine generator, and more particularly, to a turbine or a turbine generator having adjustable vanes disposed at the turbine inlet area.

2. Description of the Related Art

Among many factors, maximum and minimum flow rates are typically considered in the design of turbines that are used for air compressors of fuel cells, auxiliary power units (APU), turbo chargers, and the like. In particular, an air compressor of a turbine power generator with a fuel cell should be capable of supplying air for a fuel cell stack at an adequate flow rate, pressure, and temperature. A coaxially coupled turbine may drive the air compressor. In this case, the turbine driving the air compressor should be driven at a proper speed regardless of the flow rate variation in a working fluid injected to the turbine wheel. In other words, when the flow rate of the working fluid is higher or lower than is required, the speed and pressure of the working fluid needs to be adjusted to drive the turbine at a designed speed, such that the air compressor coaxially coupled to the turbine can be driven at a selected speed, thereby obtaining a required amount of air flow from the air compressor to the fuel cell. For this purpose, adjustable (i.e., movable) inlet vanes are installed at a gas inlet area of the turbine to adjust the flow rate and pressure of the working fluid before the working fluid reaches the turbine wheel.

FIG. 1 is a schematic diagram showing a construction of a turbine generator having a turbine with adjustable vanes, according to a conventional art.

Referring to FIG. 1, a turbine generator includes an air compressor 2, a fuel cell 3, a burner 4, a turbine 10, and generator/motor unit 1. When the turbine generator starts operation, the generator/motor unit 1 may be used as a motor for driving the air compressor 2. In other words, the operation of the turbine generator is started by the generator/motor unit 1, and then the air compressor 2 is driven. The air compressor 2 takes in air and delivers the air to the fuel cell 3 at a high pressure. The fuel cell 3 allows the oxygen of the delivered air to react with hydrogen supplied from the burner 4 such that electric power and high-temperature gas are produced. The pressure of the high-temperature gas is also high. The gas is used as the working fluid of the turbine 10. The burner 4 additionally burns the gas produced from the fuel cell 3 to increase the temperature of the gas up to a temperature required at the turbine 10. The working fluid burnt at the burner 4 flows to the turbine 10. Electric power generated from the fuel cell 3 is delivered to a three-phase system.

Generally, the turbine 10 includes vanes and a turbine wheel 7, in which the vanes control the working fluid flowing into the turbine. The vanes of the turbine 10 coaxially coupled with the air compressor 2 are adjustable vanes 6. The adjustable vanes 6 allow the working fluid to collide with the turbine wheel 7 at a desired pressure and flow rate, such that the energy of the working fluid can be converted into a mechanical energy for rotating the shaft to which the turbine wheel 7 is fixed.

The generator/motor unit 1 includes a magnetic rotor (not shown) coupled with the shaft of the turbine wheel 7 and a stator (not shown) forming a magnetic field around the magnetic rotor. The magnetic rotor starts to rotate by the rotation of the shaft of the turbine wheel 7, and this rotation of the magnetic rotor disturbs the magnetic field formed by the stator and a current is produced at the rotor, thereby enabling the generator/motor unit 1 to function as a generator.

FIG. 2 is a schematic and plan view of a turbine with movable or adjustable inlet vanes (hereinafter called as "adjustable vane turbine") according to one example of the prior art. Referring to FIG. 2, adjustable vane turbine 10 includes the turbine wheel 7 at a center, adjustable vanes 61 around the turbine wheel 7, and turbine blades 71 located around the turbine wheel 7. The adjustable vanes 61 are uniformly arranged around a turbine housing (not shown), and each adjustable vane 61 has one end portion rotatably coupled to the housing. A hydraulic system (not shown) controls the adjustable vanes 61 to rotate at the same angle with respect to the turbine housing. The hydraulic system includes a sensor detecting the flow rate of the working fluid and other hydraulic devices such as a hydraulic actuator. The hydraulic system uses the actuator to rotate the adjustable vanes 61 according to the flow rate detected by the sensor, such that the hydraulic system can control the amount of working fluid colliding with the turbine blades 71 of the turbine wheel 7 by rotating the adjustable vanes 61. It is disadvantageous to use the hydraulic system because the hydraulic system requires a higher manufacturing cost and has a nonlinear property having difficulties in controlling the system and complexities in designing the controller.

SUMMARY OF THE INVENTION

The present invention provides a turbine with adjustable vanes disposed in the turbine, and turbine generator comprising such a turbine, in which the turbine takes advantage of the hydrodynamic properties of its vane arrangement instead of using complex control methods as in the conventional art. The adjustable vanes can be automatically adjusted in response to the flow condition such as the flow rate of the working fluid, thereby simplifying the turbine system using the adjustable vanes and also reducing manufacturing costs thereof.

According to one aspect of the present invention, a turbine with adjustable vanes disposed in the turbine for controlling an inlet flow into the turbine, includes: a turbine housing; a turbine wheel installed in the turbine housing and having a rotating shaft; and a plurality of vanes pivotally installed at an inlet area of the turbine housing, wherein each of the vanes includes an adjustable vane member having one portion pivotally fixed to the turbine housing and another portion elastically supported at the turbine housing, a vane control element disposed at one side of the adjustable vane member to pivotally move the adjustable vane member in response to flow rate of a working fluid entering the turbine, and a guide element for guiding positional adjustment of the adjustable vane member.

The turbine preferably includes a link for connecting two neighboring adjustable vane members, in order to provide a synchronized motion of the vanes.

The guide element preferably includes a guide slot formed in the turbine housing and a guide pin coupled to the other portion of the adjustable vane member, with the guide pin received in the guide slot. The guide element may further include an elastic member disposed in the guide slot and for applying an elastic force to the guide pin.

The vane control element may be either a control vane or a control diffuser attached to the one side of the adjustable vane member with a set angle to each other. The control vane or control diffuse may be attached to the adjustable vane member with an angle of between 15 through 20 degrees to each other.

According to another aspect of the present invention, a turbine with adjustable vanes disposed in the turbine for controlling an inlet flow into the turbine, includes: a turbine housing; a turbine wheel installed in the turbine housing and having a rotating shaft; a plurality of vanes pivotally installed at an inlet area of the turbine housing, each of the vanes including an adjustable vane member having one portion pivotally fixed to the turbine housing and another portion elastically supported at the turbine housing; and a control vane coupled with at least one of the plurality of vanes to pivotally move the same in response to flow rate of a working fluid entering the turbine.

According to another aspect of the present invention, a turbine with adjustable vanes disposed in the turbine for controlling an inlet flow into the turbine, includes: a turbine housing; a turbine wheel installed in the turbine housing and having a rotating shaft; a plurality of vanes pivotally installed at an inlet area of the turbine housing, each of the vanes including an adjustable vane member having one portion pivotally fixed to the turbine housing and another portion elastically supported at the turbine housing; and a control diffuser coupled with at least one of the plurality of vanes to pivotally move the same in response to flow rate of a working fluid entering the turbine.

BRIEF DESCRIPTION OF DRAWINGS

The above and other features and advantages of the present invention will become more apparent by describing in detail exemplary embodiments thereof with reference to the attached drawings in which.

DETAILED DESCRIPTION OF PREFERRED EMBODIMENTS

The present invention will now be described more fully with reference to the accompanying drawings, in which exemplary embodiments of the invention are shown.

Figure 3:
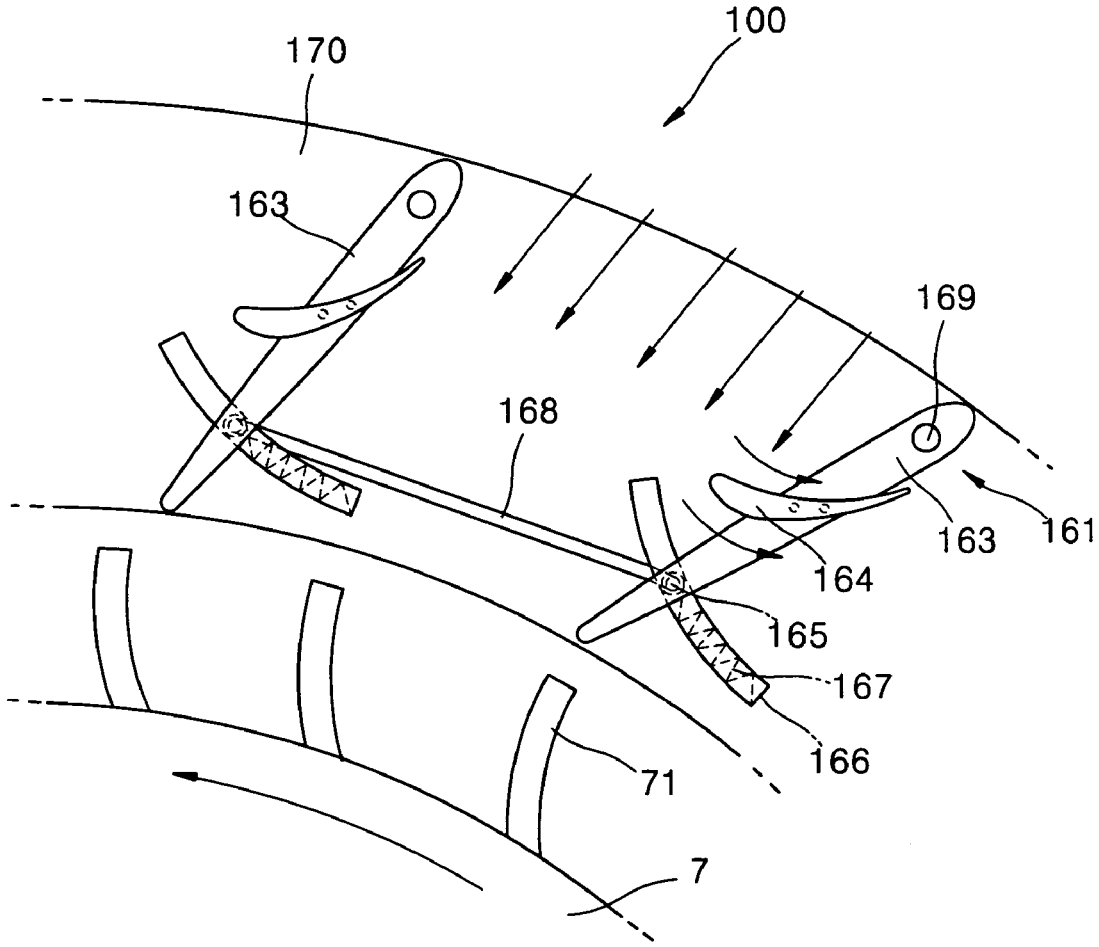
FIG. 3 is a partial and schematic diagram illustrating an adjustable vane turbine constructed according to one embodiment of the present invention.
Figure 4:
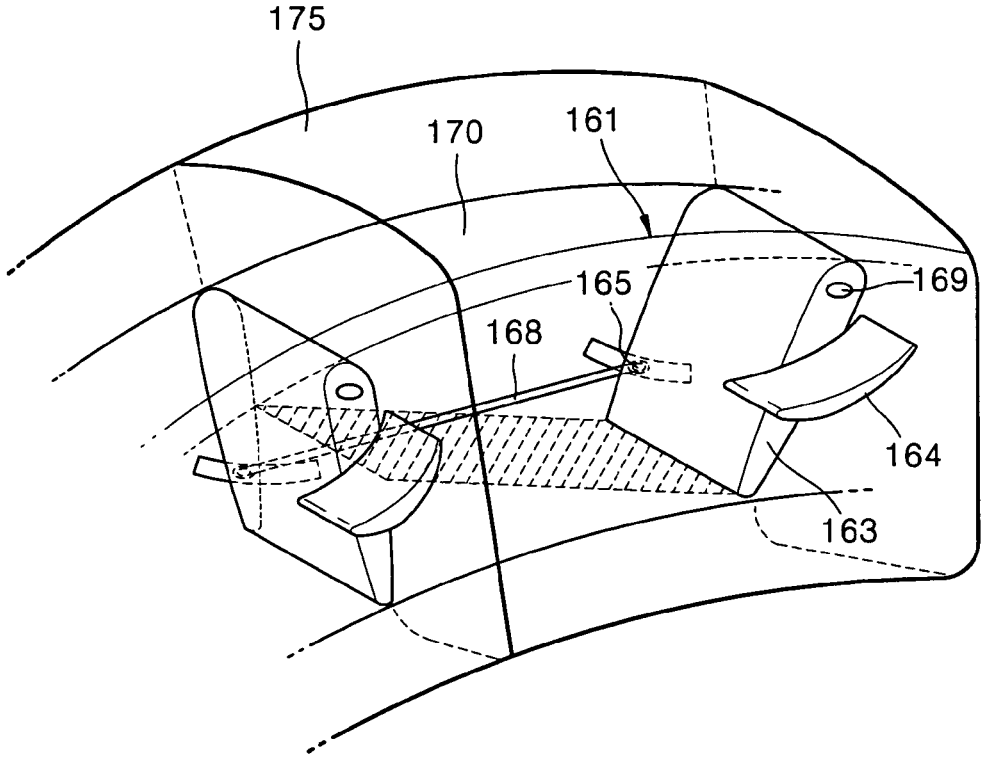
FIG. 4 is a partial, schematic and perspective diagram of the adjustable vane turbine depicted in FIG. 3.

FIG. 3 is a partial schematic diagram illustrating a construction of a turbine with variable geometry or having adjustable vanes in the inlet area of the turbine (hereinafter called as "adjustable vane turbine"), according to a first embodiment of the present invention, and FIG. 4 is a perspective diagram of the adjustable vane turbine depicted in FIG. 3.

Referring to FIGS. 3 and 4, adjustable vane turbine 100 includes a turbine housing 170, a turbine wheel 7 installed in the turbine housing 170 and rotatably supported by a shaft (not shown), and a plurality of adjustable vanes 161 pivotally disposed at the turbine housing 170 along the circumference of the turbine wheel 7 with a regular space between adjacent vanes. The adjustable vanes 161 are disposed at an inlet area of the turbine 100, and a high-temperature, high-pressure working fluid arrived at the turbine housing 170 can be directed toward the turbine blades 71 of the turbine wheel 7.

Each of the adjustable vanes 161 includes an adjustable vane member 163, a control vane 164, and a guide element for guiding the positional adjustment of the adjustable vane member 163. A portion of the adjustable vane member 163, preferably the portion adjacent to the leading edge portion of the adjustable vane member 163, is pivotally fixed to the turbine housing 170 by a pin joint 169. The control vane 164 is attached on one side of the adjustable vane member 163 with a predetermined angle with the adjustable vane 163. A guide element for guiding the positional adjustment of the adjustable vane is disposed on the other side of the adjustable vane member 163.

The shape of the control vane 164 is not limited to the shape shown in drawings, and also the attached angle of the control vane 164 may be changed according to the pressure and flow rate of the working fluid. Preferably, the attached angle of the control vane 164 can be 15 to 20 degrees with respect to each other.

The guide element includes a guide slot 166 formed in the turbine housing 170, a guide pin 165 fixed to the vane member 163 and slidably received within the guide slot 166, and an elastic member 167 disposed between the guide pin 165 and one end of the guide slot 166. The elastic member 167 may be a coil spring or other elastic element and is adapted to exert its restoring spring force toward the other end of the guide slot 166.

A link element 168 can be provided to connect the adjustable vane member 163 with a neighboring adjustable vane member 163, such that each of the adjustable vane members 163 can swing substantially at the same angle about the pin joint 169 when the control vanes 164 of the adjustable vane members 163 receive a fluidic force.

The working fluid flows along a scroll or inlet nozzle 175 (see FIG. 4) of the turbine housing 170 and passes through the adjustable vane members 163 in the arrow direction shown in FIG. 3, in which the working fluid applies a force onto the control vane 164 attached to the vane members 163. More specifically, the working fluid enters the turbine 100 in a direction generally perpendicular to the hatched line plane of the adjacent vane members 163 as shown in FIG. 4. When the flow rate of the working fluid increases, the force acting on the control vane 164 by the working fluid overcomes the restoring spring force of the elastic member 167, and thereby the adjustable vane member 163 rotates counterclockwise about the pin joint 169 and along the guide slot 166. When the flow rate of the working fluid decreases, the restoring force of the elastic member 167 overcomes the force acting on the control vane 164, and thereby the adjustable vane member 163 rotates clockwise to return its previous position. In this manner, the adjustable vanes 161 of the present invention allow the working fluid to flow into the turbine with a constant flow rate regardless of the pressure and flow rate of the working fluid at an inlet of the turbine.

Meanwhile, the shapes of the adjustable vane member 163 and the control vane 164 are not limited to the shapes shown in the drawings. For example, the control vane 164 can be formed to have a symmetric streamline shape like as the adjustable vane member 163, and the adjustable vane member 163 can have a curved streamline shape like as the control vane 164.

Figure 5:
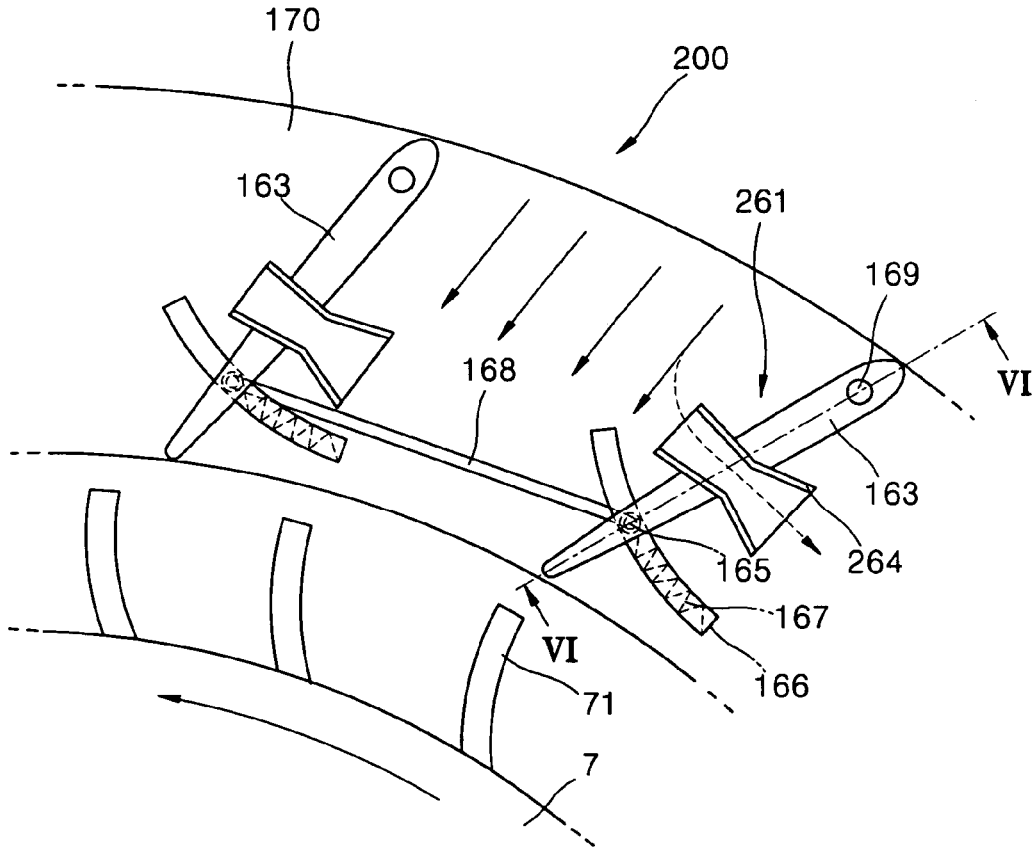
FIG. 5 is a partial and schematic diagram illustrating an adjustable vane turbine constructed according to another embodiment of the present invention.
Figure 6:
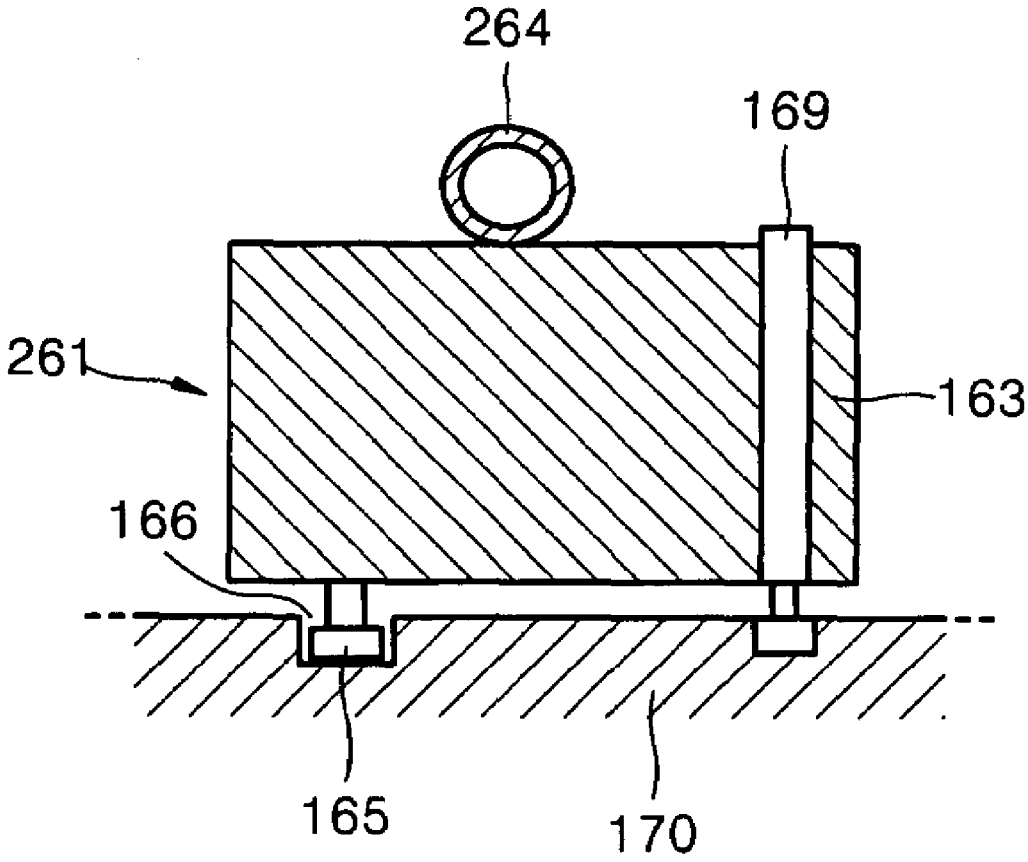
FIG. 6 is a sectional and schematic view taken from line VI-VI in FIG. 5.

FIG. 5 is a partial and schematic diagram showing a construction of an adjustable vane turbine according to another embodiment of the present invention, and FIG. 6 is a sectional view taken from line VI-VI in FIG. 5.

Referring to FIGS. 5 and 6, each adjustable vane 261 of an adjustable vane turbine 200 uses a control diffuser 264 as a vane control or adjusting element instead of the control vane 164 as in the embodiment described before.

The control diffuser 264 may be a diverging diffuser of which outlet section area is larger than inlet section area, as the diverging diffuser which is widely used in subsonic flow. The control diffuser 264 may otherwise be a converging-diverging diffuser, with its outlet area being larger than the inlet area, as shown in FIG. 5. The solid-line arrows in FIG. 5 illustrate flowing directions of the working fluid, and the dashed-line arrows through the diffuser denote a control flow direction of the working fluid. When the control flow through the control diffuser 264 increases, a force is applied in the control flow direction to rotate the adjustable vane member 163 counterclockwise. When the control flow decreases, the restoring force of the elastic member 167 urges the adjustable vane member 163 to rotate clockwise, as is similar to the first embodiment described above. In this manner, the flow rate of the working fluid flowing from the adjustable vane members 163 onto the turbine blades can be automatically adjusted to maintain within a desired level without providing a separate hydraulic or pneumatic control system as in the conventional art.

In addition, the cross sectional shape of the control diffuser 264 is not limited to that shown in FIG. 6, and the control diffuser 264 may have other sectional shapes, such as an elliptical or generally rectangular shape, instead of the circular shape in FIG. 6.

Figure 1:
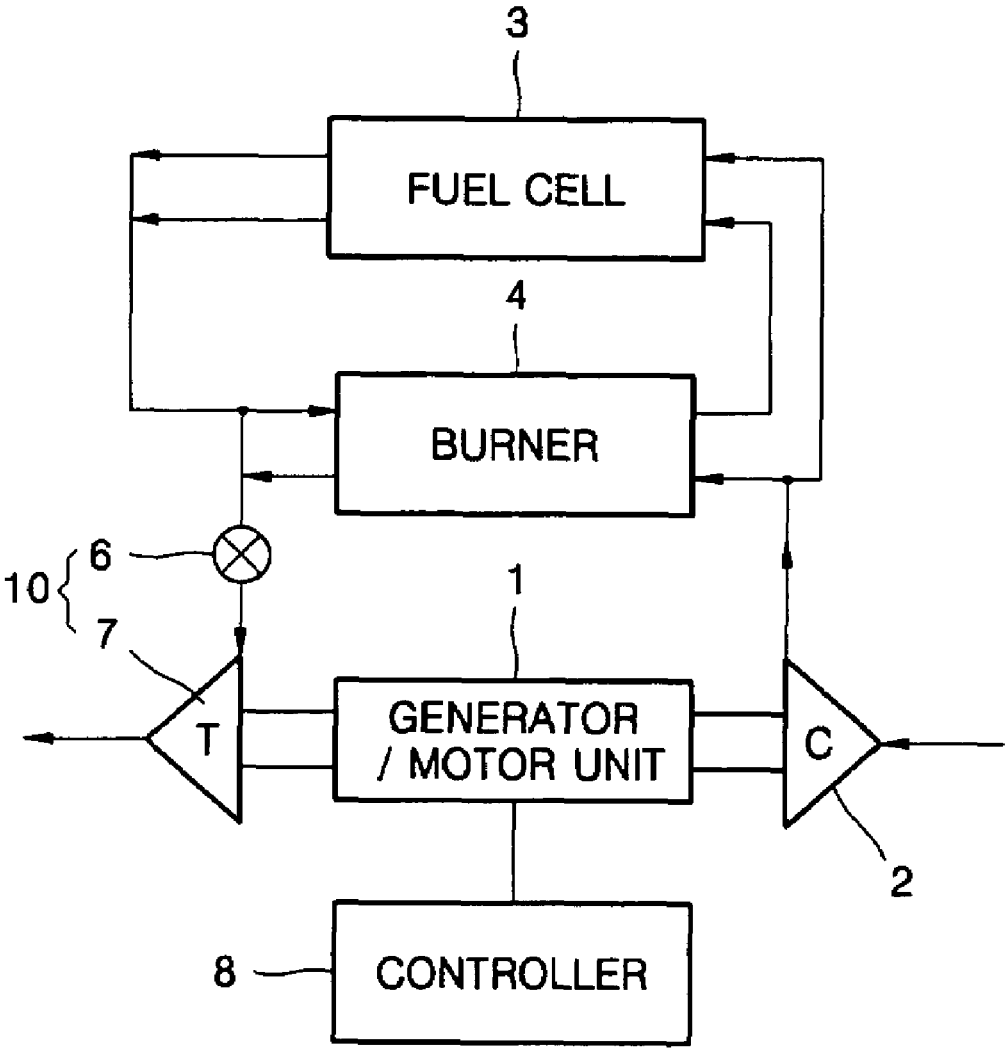
FIG. 1 (PRIOR ART)
FIG. 1 is a schematic diagram of a turbine generator according to the related art.
Figure 2:
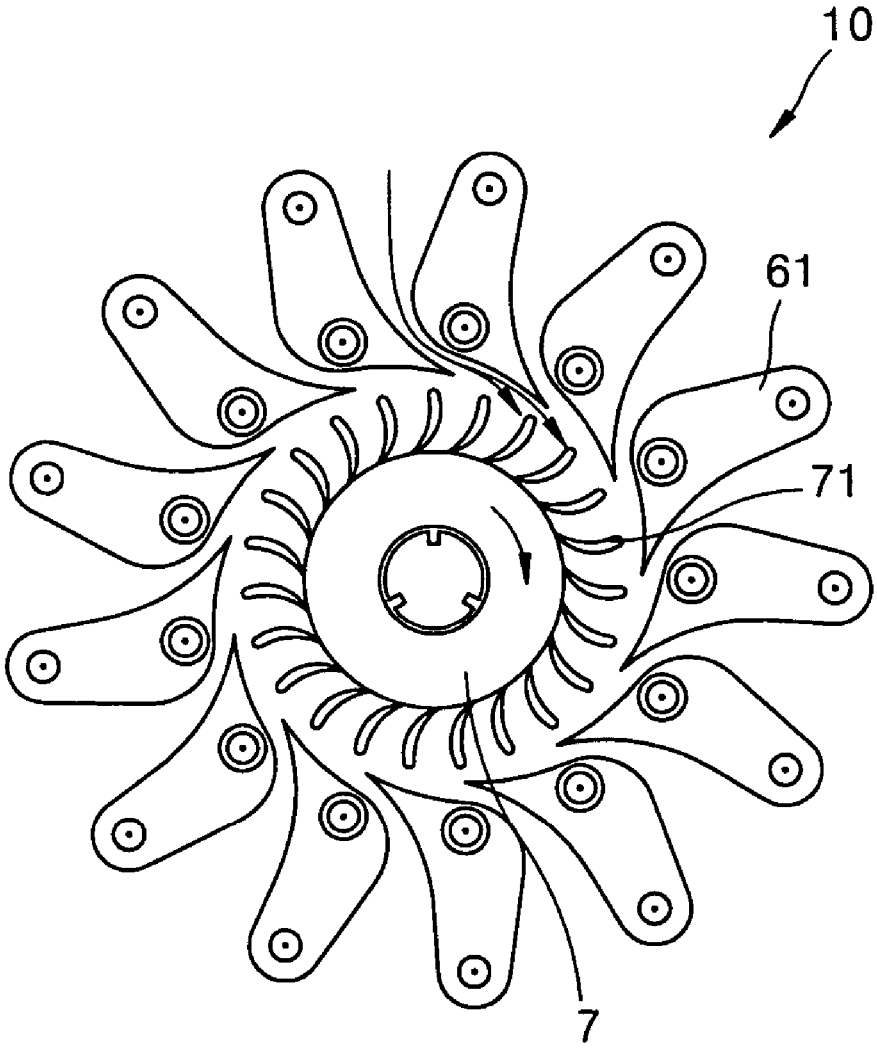
FIG. 2 (PRIOR ART)
FIG. 2 is a schematic diagram showing a construction of an adjustable vane turbine according to a conventional art.

The adjustable vane turbine, as described above in association with the exemplary embodiments, may be used in the turbine generator as shown in FIG. 1. Specifically, the air compressor must be continuously driven to stably supply the fuel cell stack with the desired amount of air. For this reason, the turbine driving the air compressor must also be driven continuously in a desired speed, regardless of the flow rate variation of the working fluid flowing into the turbine. Therefore, the adjustable vane turbine of the present invention is provided to maintain stable operation of the turbine regardless of the flow rate variations in the working fluid.

As described above, the present invention takes advantage of hydrodynamic property of the foil or vane or the diffuser, instead of using the complex control method of the conventional art, such that the adjustable vanes can be automatically adjusted in response to the flow conditions such as the flow rate of the working fluid, thereby simplifying the turbine system using the adjustable vanes and thus reducing the manufacturing costs.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A turbine having adjustable vanes disposed in the turbine for controlling an inlet flow into the turbine, said turbine comprising:

a turbine housing;

a turbine wheel installed in the turbine housing and having a rotating shaft; and a plurality of vanes pivotally installed at an inlet area of the turbine housing, wherein each of the vanes includes an adjustable vane member having one portion pivotally fixed to the turbine housing and another portion elastically supported at the turbine housing, a vane control element disposed at one side of the adjustable vane member to pivotally move the adjustable vane member in response to flow rate of a working fluid entering the turbine, and a guide element for guiding positional adjustment of the adjustable vane member.

2. The turbine of claim 1, further including a link for connecting two neighboring ones of the vanes.

3. The turbine of claim 1, wherein the guide element includes a guide slot formed in the turbine housing and a guide pin coupled to the other portion of the adjustable vane member, the guide pin being received in the guide slot.

4. The turbine of claim 3, wherein the guide element further includes an elastic member disposed in the guide slot and for applying an elastic force to the guide pin.

5. The turbine of claim 1, wherein the vane control element is a control vane attached to the one side of the adjustable vane member with a set angle to each other.

6. The turbine of claim 5, wherein the control vane is attached to the adjustable vane member with an angle of between 15 through 20 degrees to each other.

7. The turbine of claim 1, wherein the vane control element is a control diffuser attached to the one side of the adjustable vane member with a set angle to each other.

8. The turbine of claim 7, wherein the control diffuser is attached to the adjustable vane member with an angle of between 15 through 20 degrees to each other.

9. A turbine having adjustable vanes disposed in the turbine for controlling an inlet flow into the turbine, said turbine comprising:

a turbine housing;

a turbine wheel installed in the turbine housing and having a rotating shaft;

a plurality of vanes pivotally installed at an inlet area of the turbine housing, each of the vanes including an adjustable vane member having one portion pivotally fixed to the turbine housing and another portion elastically supported at the turbine housing; and a control vane coupled with at least one of the plurality of vanes to pivotally move the same in response to flow rate of a working fluid entering the turbine.

10. The turbine of claim 9, further including a link element for connecting two neighboring ones of the vanes.

11. The turbine of claim 9, wherein the turbine housing includes at least one guide slot with an elastic element received in the guide slot for the elastically supporting the adjustable vane member at the turbine housing.

12. The turbine of claim 11, wherein the adjustable vane member includes a guide pin coupled to the guide slot of the turbine housing.

13. A turbine having adjustable vanes disposed in the turbine for controlling an inlet flow into the turbine, said turbine comprising:

a turbine housing;

a turbine wheel installed in the turbine housing and having a rotating shaft;

a plurality of vanes pivotally installed at an inlet area of the turbine housing, each of the vanes including an adjustable vane member having one portion pivotally fixed to the turbine housing and another portion elastically supported at the turbine housing; and a control diffuser coupled with at least one of the plurality of vanes to pivotally move the same in response to flow rate of a working fluid entering the turbine.

14. The turbine of claim 13, further including a link element for connecting two neighboring ones of the vanes.

15. The turbine of claim 13, wherein the turbine housing includes at least one guide slot with an elastic element received in the guide slot for the elastically supporting the adjustable vane member at the turbine housing.

16. The turbine of claim 15, wherein the adjustable vane member includes a guide pin coupled to the guide slot of the turbine housing.

* * * * *